United States Patent [19]

Hwang et al.

[11] Patent Number: 4,838,825

[45] Date of Patent: Jun. 13, 1989

[54] TOY KIDDIELAND

[76] Inventors: Chi Yung Hwang, No. 1, Lane 20, Chung Cheng N. Rd., Sun Chong City, Taipei Hsien; Liu Ping Chih, No. 29, Lane 426, Wor Long St., Taipei City, both of Taiwan

[21] Appl. No.: 152,848

[22] Filed: Feb. 5, 1988

[51] Int. Cl.[4] ..... A63H 33/26

[52] U.S. Cl. ..... 446/136; 40/426

[58] Field of Search ..... 446/135, 134, 133, 131, 446/129, 136; 40/426; 272/31 R, 31 P; 273/1 M

[56] References Cited

U.S. PATENT DOCUMENTS

| | | | |
|---|---|---|---|
| 2,220,049 | 10/1940 | Dunmore | 446/136 X |
| 2,645,879 | 7/1953 | Richter | 446/136 X |
| 2,827,296 | 3/1958 | Walker | 446/136 X |
| 4,177,592 | 12/1979 | Ruck | 446/136 X |

FOREIGN PATENT DOCUMENTS

| | | | |
|---|---|---|---|
| 521171 | 3/1931 | Fed. Rep. of Germany | 40/426 |
| 1404530 | 12/1965 | France | 446/136 |

*Primary Examiner*—Mickey Yu

*Attorney, Agent, or Firm*—Leonard Bloom

[57] ABSTRACT

A toy assembly utilizing the force produced by magnets to move models for the user's enjoyment. The toy has a base with a motor and magnets as a power source. A rotary plate with shafts freely disposed through the plate for upward and downward movement, the shafts are provided with magnets for altering the field of magnetism when the rotary plate is rotated. A shell covers the rotary plate and is provided with a display disk having implements and human models that move in response to the fields of magnetism.

5 Claims, 2 Drawing Sheets

TOY KIDDIELAND

FIELD OF THE INVENTION

The present invention relates to a toy kiddieland, and more particularly to a toy assembly that utilizes the force of magnetism to motivate models.

BACKGROUND OF THE INVENTION

The use of a magnetism to motivate models on children's toys, such as a toy kiddieland, is known. However, such devices have certain limitations. First, these devices do not provide a means whereby a model or models may be satisfactorily moved over a curved surface at a constant rate. Second, present devices provide for only a relatively limited number of models and/or activities to be simultaneously performed. Finally, these devices have relatively limited mechanisms for driving the magnets to permit the simultaneous performance of a variety of activities by a variety of models over disparate portions of the display surface.

Thus, it can be seen that there remains a need to provide a device which utilizes the force of magnetism and which overcomes any or all of the limitations mentioned above.

SUMMARY OF THE INVENTION

A primary feature of the present invention is to provide a toy kiddieland comprising a display disk having a variety of different kinds of merry implements which include human models and implements that are moved by magnetic effect.

Another feature of the present invention is to provide a toy kiddieland including a motor to rotate a plate which has several magnets mounted on. As the plate is rotated, the magnetic field in changed, such that the magnets on the models on the display disk move.

These and other objective and advantages of the present invention will become apparent from the following detailed description thereof when read in conjunction with the accompanying drawings.

DETAILED DESCRIPTION OF THE EMBODIMENTS

Figure 1:
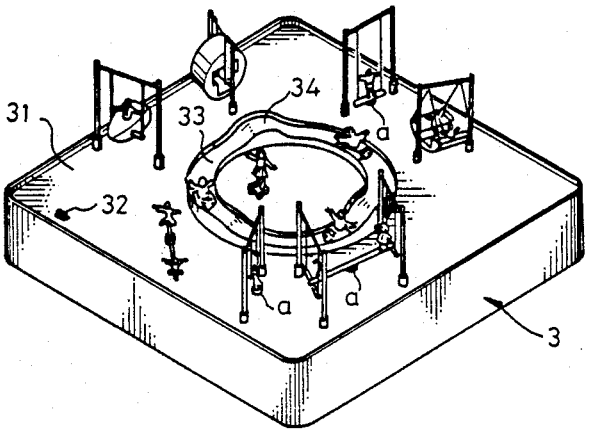
FIG. 1 is a perspective view of a preferred embodiment of the toy of the present invention.
Figure 2:
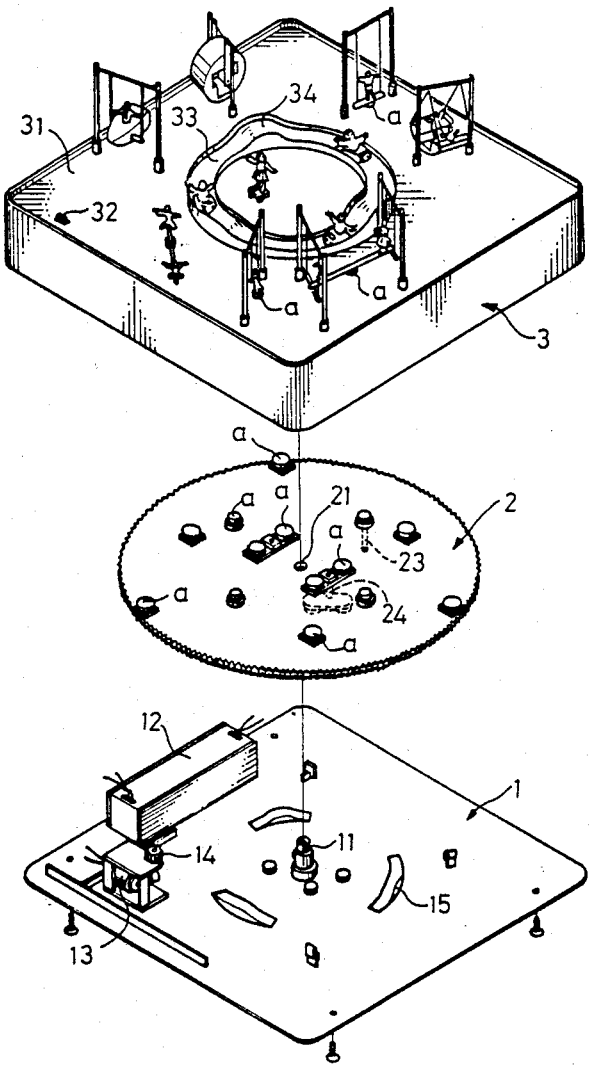
FIG. 2 is a exploded perspective view of the toy of FIG. 1.

Referring now to the drawings, the toy kiddieland includes a base 1, a rotary plate 2 and a housing or shell 3.

The base 1 is substantially rectangular and includes a center through which an upwardly-extending shaft 11 is disposed. A battery assembly 12 and a motor 13 are both mounted on the base 1. A wheel 14 is rotated by the motor 13. This drive wheel 14 is accompanied by a gear assembly. At least three upwardly-curved surfaces (convexes) 15 are formed on the base 1. These surfaces 15 are spaced about the center of the base 1 and are substantially arcuate or curved in shape, so as (as is seen in the Figures) to have the same radius from (to be equidistant or the same distance from) the shaft 11 which is positioned at the centerpoint of the base 1. Several magnets also are positioned on the base 1.

A rotary plate 2 has a hole 21 formed therein at the center thereof. The rotary plate 2 is received on the upper end of the shaft 11 and is rotatably received in the hole 21 for supporting the plate 2 for rotational movement about the center thereof. The circumference of the plate 2 has teeth formed thereon which engages the drive wheel 14 and is rotated thereby. At least one and preferably several vertically-movable rotary plate magnet having free sticks (magnetic shaft portions) are slidably disposed through plate 2, so that the shafts 23 can move up and down freely by sliding substantially vertically through the plate 2. The top (upper) end of each stick (magnetic shaft) 23 is located above the plate 2 and is mounted or equipped with a respective magnet (upper magnetic portion) so that the shaft 23 extends downwardly therefrom. Furthermore, each stick (magnetic shaft) 23 is spaced about and substantially equidistance from the hole 21. In this respect, it is noted that the distance from the center hole 21 to each stick (shaft) 23 is the same as the radius of the surfaces (convexes) 15 relative to the shaft 11. In this fashion, when the plate 2 is rotated, the low end (lower free end) of each stick 23 (which is located below the plate) sequentially contacts the respective surfaces 15 and the stick or shaft 23 will be vertically raised up when it contacts the surface (convex) 15 and will be vertically lowered when it is located between surfaces (15). At least one, and preferably two, I-shaped rotary shafts (rotary magnet shafts) 24 are rotatably disposed extending through the plate. These shafts 24 have an upper end and a lower end located, respectively, above and below the plate 2. Disposed thusly, shafts 24 rotate freely. A pair of magnets are located on both the upper and lower ends and rotated therewith. Similarly, there is at least one and preferrably several magnets (field rotary plate magnets) mounted or otherwise disposed on the plate 2 in various concentric and random arrangements about the hole 21.

The housing shell 3 is positioned completely over the base, with the plate 2 disposed therebetween and is connected with the base 1 by screws or other suitable means. A display disk (upper display surface) 31 is provided on the upper surface of the shell (housing) 3. A switch 32 to control electric flow to the motor is provided protruding through the surface 31. A sliding track (circular track) 33 is placed substantial concentrically around the center of the housing 3. This track 33 has at least three projections or upwardly-curved surfaces 34 which are positioned substantially vertically above the surface 15. At least one and, preferably several merry and/or athletic implements or models are provided. These models may have either pivotably swinging or movable portions such as a horizontal bar, a swing, or a seesaw, or which are themselves movable, such as a canoe and so on, are disposed on the circular track and on the display disk 31 spaced from the track 33. Also human models are provided. The movable models are equipped with a magnet positioned thereon. Also, the swinging or movable portions have a magnet.

Finally, it is noted that the centers of the base, the housing and the rotary plate are substantially aligned with one another.

In use with switch 32 turned on, the wheel 41 is rotated by motor 13. This wheel 14 rotatably drives the rotary plate 2 about the shaft 11. Owing to the magnetic field of magnets a, that is created by rotation of the plate 2 about shaft 11, the I-shaped rotary shaft 24 revolve on this respective axes. This rotary movement of the plate 2 brings the free ends of the shafts 23 in and out of contact with surfaces 15 vertically moving shafts 23 as the free ends, thereof come, respectively, in and out of contact with surfaces 15. In this manner, the same distance between the magnets a on the top of the sticks 23 and the sliding track 33 is maintained. As a result, the magnets a on the human models and the canoe as well as on all the implements on the display disk display surface 31 are moved by the magnetic fields, thereby moving either the model itself or the movable portions thereof, such as the horizontal bar, the swing, and the seesaw.

Thus, it can be seen that the structure of the toy of the present invention is simple, economic and easily made.

Having described specific preferred embodiments of the invention with reference to the accompanying drawings, it will be appreciated that the present invention is not limited to those precise embodiments, and that various changes and modifications may be made thereto by one of ordinary skill in the art without departing from the scope or spirit of the invention as defined by the appended claims.

What is claimed is:

1. A toy kiddieland comprising:

a base including a center shaft, a motor and a battery assembly mounted on the base; a drive wheel associated with the motor for being rotated thereby; three convexes being positioned on the base around the shaft; and several magnets placed on the base;

a rotary plate including at least three sticks and two I-shaped rotary shafts disposed extending therethrough, each of the sticks and shafts having respective magnets connected thereto; the rotary plate further having a center hole formed therein for receiving the center shaft therein, such that the rotary plate rotates thereon, the rotary plate further having a circumference engaged by the drive wheel, whereby the plate is rotated by the drive wheel;

a sheel covering the rotary plate, the shell including an upper display disk with a switch mounted thereon for controlling the operation of the motor, a sliding track having three projections formed thereon, each projection positioned above a respective convex; and a plurality of implements and human models being disposed on the upper display disk, each of said implements and models having a respective magnet disposed thereon, whereby rotation of the plate by the rotary wheel forms magnetic fields between the magnets on the base, the rotary wheel, the implements and the models moving the implements and models.

2. A toy comprised of:

a base having a center and at least three upwardly-raised curved surfaces formed thereon, each of said surfaces positioned spaced about and substantially equidistant from the center of the base;

a housing positioned over the base, the housing having a center and an upper display surface, the upper display surface having a circular track disposed thereon disposed concentrically about the center of the housing, the circular track including at least three upwardly-raised curved surfaces formed thereon, each of the curved surfaces of the track being positioned substantially above one of the respective curved surfaces of the base, at least one model disposed on the circular track, said model having a respective magnet disposed thereon;

a rotary plate having a center, the rotary plate being disposed between the housing and the base for rotational movement thereof about the center of the plate, the rotary plate further having at least one vertically movable rotary plate magnet, said vertically movable rotary plate magnet being positioned spaced about and substantially equidistant from the center of the plate, said vertically movable rotary plate magnet having an upper magnetic portion located above the plate and a shaft portion extending downwardly therefrom, the shaft portion having a respective upper end secured to the upper magnetic portion above the plate and a respective lower free end located below the plate, such that the shaft portion freely slides vertically upwardly and downwardly through the rotary plate;

the centers of the base, the housing and the rotary plate being substantially vertically aligned with one another; and means for rotating the rotary plate and the magnet thereon, such that the free end of the shaft of the rotary plate magnet contacts the curved surfaces on the base vertically moving the shaft portion and the magnetic portion of the rotary plate magnet upwardly and downwardly under the circular track, whereby the model on the circular track is moved concommittantly therewith on the circular track.

3. The toy of claim 2, further comprised of:

the housing having at least one model disposed on the upper display surface spaced from the circular track, said model having a respective magnet disposed thereon;

the rotary plate having at least one fixed rotary plate magnet disposed thereon, such that when the rotary plate is rotated, the magnetic field of the fixed rotary plate magnet moves the movel on the display surface that is spaced from the circular track.

4. The toy of claim 2, further comprised of:

the housing having at least one model disposed on the upper display surface spaced from the circular track, said model having a respective magnet disposed thereon;

at least one magnet shaft rotatably disposed extending through the rotary plate, each magnet shaft having a respective upper end located above the rotary plate and a lower end located below the rotary plate, each shaft further including a respective pair of magnets disposed on the upper end thereof and respective pair of magnets disposed on the lower end thereof;

wherein when the rotary plate is rotated, the magnetic fields of the magnets rotate the magnetic shaft having the respective pairs of magnets located on either end thereof and moving the model on the display surface that is spaced from the circular track.

5. A toy comprised of:

a base having a center and at least three upwardly-raised curved surfaces formed thereon, each of said surfaces positioned spaced about and substantially equidistant from the center of the base;

a housing positioned over the base, the housing having a center and an upper display surface, the upper display surface having a circular track disposed thereon positioned concentrically about the center of the housing, the circular track including at least three upwardly-raised curved surfaces formed thereon, each of the curved surfaces of the track being positioned substantially above one of the respective curved surfaces of the base, a plurality of models disposed on the upper display surface and the circular track, each of said models having a respective magnet disposed thereon;

a rotary plate having a center, the rotary plate being disposed between the housing and the base for rotational movement of the rotary plate about the center thereof, the rotary plate further having a plurality of rotary plate magnets carried thereby, a portion of the rotary plate magnets being vertically movable rotary plate magnets, the vertically movable rotary plate magnets positioned spaced about and substantially equidistant from the center of the plate, the vertically movable rotary plate magnets having an upper magnetic portion located above the plate and a shaft portion extending downwardly therefrom, the shaft portions having a respective upper end secured to the magnetic portion and a respective lower free end located below the plate, such that the shaft portion freely slides vertically upwardly and downwardly through the rotary plate;

the centers of the base, the housing and the rotary plate being substantially vertically aligned with one another; and means for rotating the rotary plate and the magnets thereon, such that the free end of the shaft of the vertically movable rotary plate magnets contact the curved surfaces on the base vertically moving the shaft portions and the magnetic portions of the vertically movable rotary plate magnets upwardly and downwardly under the circular track, and further such that all of the magnets of the rotary plate are rotated forming magnetic fields between the magnets on the rotary plate and the models, whereby at least a portion of each of the models is moved.

* * * * *